United States Patent [19]

Anderson, Jr. et al.

[11] Patent Number: 4,510,418

[45] Date of Patent: Apr. 9, 1985

[54] RAPID START FLUORESCENT LAMP WITH A BIMETAL ELECTRODE DISCONNECT SWITCH

[75] Inventors: John W. Anderson, Jr., Ipswich; William J. Roche, Merrimac, both of Mass.

[73] Assignee: GTE Products Corporation, Stamford, Conn.

[21] Appl. No.: 644,905

[22] Filed: Aug. 28, 1984

Related U.S. Application Data

[63] Continuation-in-part of Ser. No. 632,262, Jul. 18, 1984, abandoned, which is a continuation of Ser. No. 546,072, Oct. 27, 1983, abandoned, which is a continuation-in-part of Ser. No. 494,841, May 16, 1983, abandoned.

[51] Int. Cl.[3] ..... H01J 7/44; H01J 17/34; H01J 19/78; H01J 29/96

[52] U.S. Cl. ..... 315/73; 315/74; 315/106; 315/119

[58] Field of Search ..... 315/73, 74, 76, 106, 315/107, 119, 362

[56] References Cited

U.S. PATENT DOCUMENTS 4,097,779 6/1978 Latassa ..... 315/106
4,156,831 5/1979 Cassidy et al. ..... 315/106

FOREIGN PATENT DOCUMENTS 2902295 9/1979 Fed. Rep. of Germany ..... 315/73

*Primary Examiner*—Saxfield Chatmon
*Attorney, Agent, or Firm*—Thomas H. Buffton

[57] ABSTRACT

A rapid start fluorescent lamp having a glass envelope with a phosphor coated inner surface, a low pressure gas fill and an electrode at each end includes at least one electrode disconnected switch having a bimetal switch normally closed at room temperature and open at a predetermined temperature higher than room temperature with the bimetal switch connected to the electrode and to an electrical lead extending from the lamp to an energization source.

11 Claims, 3 Drawing Figures

RAPID START FLUORESCENT LAMP WITH A BIMETAL ELECTRODE DISCONNECT SWITCH

CROSS-REFERENCES TO RELATED APPLICATIONS

This application is a continuation-in-part of application Ser. No. 632,262, filed July 18, 1984, now abandoned which was a continuation of application Ser. No. 546,072, filed Oct. 27, 1983, now abandoned, which was a continuation-in-part of application Ser. No. 494,841, filed May 16, 1983, now abandoned.

TECHNICAL FIELD

This invention relates to rapid start fluorescent lamps and more particularly to rapid start fluorescent lamps having a bimetal electrode disconnect switch affixed to one electrode for discontinuing heater current flow upon effecting conductivity of the lamp.

BACKGROUND ART

In the fluorescent lamp art both preheat type and rapid start type fluorescent lamps are commonly encountered. In the preheat type of fluorescent lamp, heater current flows through the electrode only during lamp ignition whereupon an external voltage sensitive starter opens the heater current circuit and discontinues heater current flow. In contrast the rapid start fluorescent lamp normally has a constant heater current flow through each electrode both during ignition and operation of the lamp. Unfortunately, heater current flow during operation of the rapid start fluorescent lamp is lost power which obviously reduces the operational efficiency of rapid start fluorescent lamps.

Numerous suggestions have been made for enhancing efficiency of rapid start fluorescent lamps. For example, U.S. Pat. Nos. 4,052,687; 4,097,779; 4,114,968; 4,156,831 and 4,171,519, all assigned to the Assignee of the present application, suggest numerous configurations for enhanced operation of rapid start fluorescent lamps. Generally, each provides a thermally responsive circuit breaker suitable for use in discontinuing heater current upon operation of the fluorescent lamp.

However, it has been found that problems still exist. For example, it has been found that a problem occurs whenever the thermally responsive circuit breaker extends in a direction parallel to the electrode of a lamp but for a distance greater than the length of the electrode. Thereupon, positioning the lamp envelope properly is encumbered because the envelope tends to undesirably contact the circuit breaker when the circuit breaker and lamp electrodes are being inserted into the envelope. Such an encounter is obviously undesirable, and especially so in a high production manufacturing process.

In another aspect, it has been found that positioning of the circuit breaker too close to the electrode has a deleterious effect upon the life span of the fluorescent lamp. More specifically, closely spacing the circuit breaker to an electrode generating heat tends to significantly reduce the life span of the fluorescent lamp wherein the electrode is located.

In still another aspect of the invention, it has been found that the consistency and repeatability of operation of a circuit breaker disposed within a discharge lamp can be adversely affected when left unprotected from the environment within the discharge lamp. In other words, a bimetal switch means placed nearby an activated electrode within a discharge lamp may be deleteriously affected when protection is not provided such that the bimetal switch surfaces are not isolated from the environment surrounding the lamp electrode.

OBJECTS AND SUMMARY OF THE INVENTION

An object of the present invention is to provide an enhanced rapid start fluorescent lamp. Another object of the invention is to improve the operating efficiency of a rapid start fluorescent lamp. Still another object of the invention is to improve the capabilities for manufacture of the above-described enhanced rapid start fluorescent lamp. A further object of the invention is to reduce the energy requirements during operational use of a rapid start fluorescent lamp.

These and other objects, advantages and capabilities are achieved in one aspect of the invention by a rapid start fluorescent lamp having an envelope with a phosphor-coated inner wall surface, a low pressure fill gas, an electrode within each end of the envelope and a pair of electrically conductive leads passing through each end of the envelope for coupling an electrode to an energizing source wherein an electrode disconnect switch has a bimetal switch means normally closed at room temperature and open at a predetermined temperature higher than room temperature and spaced from at least one of the electrodes.

In another aspect of the invention, a rapid start fluorescent lamp has an electrode disconnect switch therein which includes a bimetal switch means within a glass bottle with a pair of electrical conductors connecting the bimetal switch means to an electrode within the lamp and to an electrical lead passing through the discharge lamp to an energizing source.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
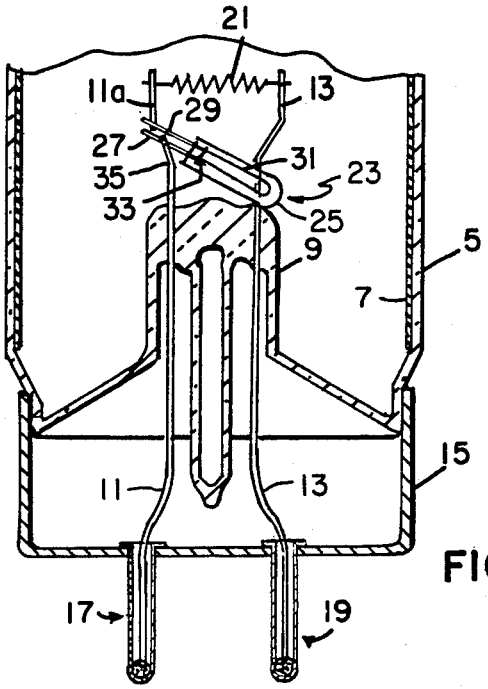
FIG. 1 is an elevational view, partly in section, of one end of a rapid start fluorescent lamp prior to processing.
Figure 2:
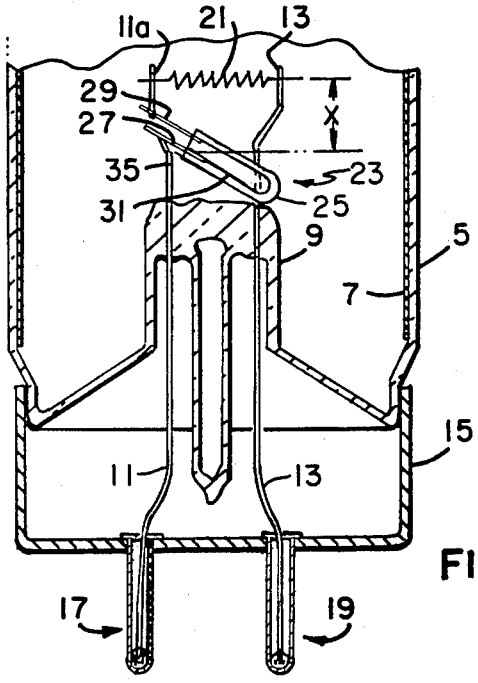
FIG. 2 is an elevational view, partly in section, of one end of a rapid start fluorescent lamp of the invention.

Referring to FIGS. 1 and 2 of the drawings, a rapid start fluorescent lamp suitable for processing includes an elongated glass envelope 5 having a coating 7 of phosphor on the inner wall surface of the envelope 5. A glass stem member 9 is sealed into the end of the envelope 5 and includes a pair of electrical leads 11 and 13 sealed therein and passing therethrough. An end cap 15 is telescoped over and attached to the end of the glass envelope 5 and includes a pair of pins 17 and 19 electrically connected to a portion of the electrical leads 11 and 13 and formed to provide electrical connection to an external potential source of energization (not shown). Moreover, the envelope 5 has a gas fill therein selected from the group consisting of argon, xenon, krypton, neon, helium and combinations thereof.

Within the envelope 5, an electrode 21 has one end thereof connected to one of the electrical leads 13 and a longitudinal axis which extends in a direction substantially normal to the direction of the electrical leads 11 and 13 (i.e., normal to the longitudinal axis of the lamp). The electrode 21, which is often referred to as a heater or cathode is of a well known type used in rapid start fluorescent lamps and includes a coating thereon which is usually in the form of alkaline earth oxides applied thereto in the form of carbonates which, upon processing, are converted to oxides.

The opposite end of the electrode 21 is connected to electrical lead segment 11*a* which is, in turn, connected by way of an electrode disconnect switch 23 and the electrical lead 11 to the pin 17. The electrode disconnect switch 23 is preferably in the form of a glass bottle 25 having a pair of electrical conductors 27 and 29 sealed into one end. A bimetal switch 31 is located within the glass bottle 25 and connected intermediate the electrical conductors 27 and 29. A meltable bypass member 33 is affixed to the conductors 27 and 29 in shunting relationship to the bimetal switch 31, as shown in FIG. 1 only. Moreover, a vacuum or a gas fill of noble gases or nitrogen or combination thereof is contained within the glass bottle 25. Thus, electrical connection between the electrode 21 and the pin 17 is effected by way of the electrical lead segment 11*a*, the electrical conductors 29 and 27 of the disconnect switch 23, with the bimetal switch 31 or the bypass member 33 connected therebetween, as will be explained hereinafter, and the electrical lead 11.

Alternatively, the electrode disconnect switch 23 may be in the form of a bimetal switch 31 (i.e., without a bottle 25) having either a substantially U-shaped or straight configuration which would be located within the lamp envelope. Although a hermetically sealed glass bottle 25 having a gas fill is preferable, the switch 31 may have an insulating cover or be disposed within a bottle merely shielding the switch 31 from the electrode 21 or merely be configured to protect the switch contact from undesirable environmental factors. Also it is conceivable that the electrode disconnect switch 23 could be of a form wherein the electrical conductors 27 and 29 exit from opposite ends of the glass bottle 25.

Of course, there is an electrode 21 within each of the opposite ends of the lamp envelope 5, FIGS. 1 and 2 showing just one end of the lamp. The lamp can include only one disconnect switch 23 or have a pair of switches 23, each connected to an electrode at each end of the lamp.

As to manufacture, it is well known that the glass envelope 5 has the glass stem member 9 inserted therein and sealed thereto. Accordingly, it has been found most expedient to position the electrode disconnect switch 23 in a manner such that the switch 23 is located between and does not extend beyond a pair of substantially parallel planes extending in a direction normal to the longitudinal axis of the electrode 21 and intercepting the ends of the electrode 21. Thus, it has been found that the electrode disconnect switch 23 is not normally disturbed when the envelope 5 is telescoped over the electrode 21 since the disconnect switch 23 does not extend beyond a plane normal to the ends of the electrode 21.

As to operation of the electrode disconnect switch 23, it is known that the previously-mentioned alkali earth oxides on the electrode 21 are derived from a coating of carbonates during the manufacturing process. Normally, this process is effected by applying current to the electrical leads 11 and 13 in an amount sufficient to raise the temperature of the electrode to about 1700° C.

However, the bimetal switch 31, which is normally closed at room temperatures, tends to operate or open at a temperature in the range of about 140° C. to 180° C. in a 40-watt type lamp. By 40-watt type is meant a T-12, 4-foot lamp operating at 350 to 475 ma, including both standard 40-watt lamps and lower wattage energy saving lamps. Thus, the process temperatures employed to bake and seal the envelope 5 to the glass stem member 9 would tend to activate the bimetal switch 31. Moreover, current applied to the leads 11 and 13 would fail to effect the desired 1700° C. temperature of the electrode 21 for processing the carbonates thereon since the bimetal switch 31 is operational and would interrupt the process.

In order to achieve this desired processing of the electrode 21 during manufacture, a bypass member 33 of a refractory material, such as molybdenum or stainless steel, is connected across the electrical conductors 27 and 29 of the electrical disconnect switch 23. This bypass member 33 is of a meltable material and in response to an electrical pulse potential, such as a pulse from a 270 microfarad capacitor charged to 300 v D.C., is removed or melted away after processing the carbonates to provide the desired electrode disconnect switch 23 capability, this final condition being shown in FIG. 2.

Additionally, it has been found that the position of the electrode disconnect switch 23 with respect to the electrode 21 within the lamp envelope 5 is important. Rapid start fluorescent lamps may be of different wattages and of a length of 3, 4, 6 or 8-foot, for example. It has been found that the electrode disconnect switch 23 should be spaced in the range of about 8.0 to 14.0 mm from the electrode 21. More specifically, the positioning of the electrode disconnect switch 23 should be such that the average spacing, X of FIG. 2, between the switch 23 and the electrode 21 is not less than about 8.0 mm and not more than about 14.0 mm. Also, the electrode disconnect switch 23 should be of a material and configuration to operate at temperatures in the range of about 75° C. to 300° C. depending upon the capacity of the lamp and the location of the disconnect switch with respect to the electrode 21.

In the case of a 40-watt type T-12 lamp having a length of about 4 feet and operable at a current in the range of about 350 to 475 ma. from a standard F-40 ballast, use of a pair of disconnect switches 23 in accordance with the invention resulted in an energy saving of about $2\frac{1}{2}$ watts per lamp, while maintaining lumen output and lamp life. The temperature necessary to operate the electrode disconnect switch 23 in the above mentioned 40-watt type lamp is preferably in the range of about 140° C. to about 180° C.

Figure 3:
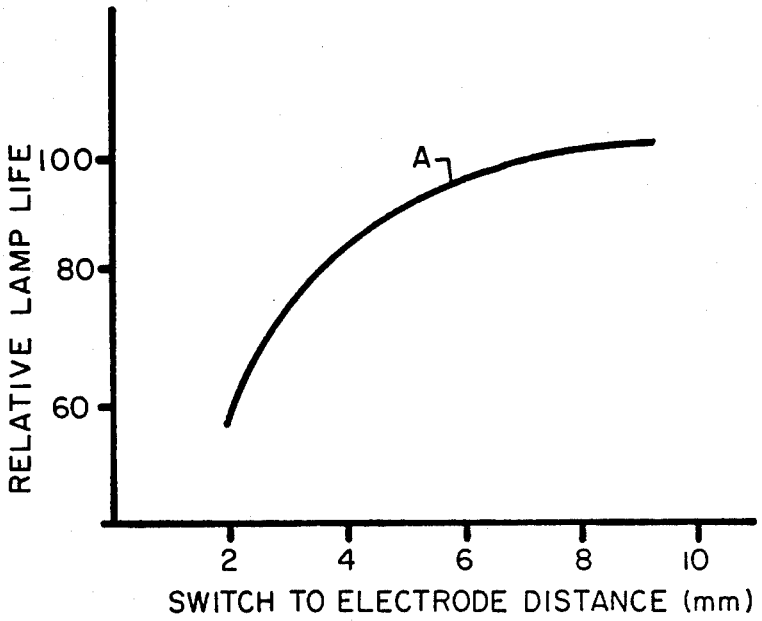
FIG. 3 is a chart illustrating the relative life of a 40-watt type rapid start fluorescent lamp with regard to the average or mean distance of an electrode disconnect switch from the lamp electrode.

By way of example, it is to be noted that curve A of FIG. 3 provides a comparison chart for a 40-watt type rapid start fluorescent lamp which compares relative lamp life, in percentages, with the average distance of the disconnect switch 23 from the electrode 21 at each end of the lamp. As can readily be seen, the relative lamp life increases at a relatively rapid rate as the spacing between the disconnect switch 23 and electrode 21 increases. However, this increased lamp life tends to level off at a spacing of about 8.0 mm. Characteristics similar to those illustrated by curve A of FIG. 3 are also applicable to lamps of other wattages and sizes.

Tests indicate that a spacing between the switch 23 and electrode 21 of greater than about 14.0 mm. creates problems in achieving the desired temperatures consistent with proper operation of the disconnect switch 23.

Thus, there has been provided a rapid start fluorescent lamp which includes an electrode disconnect switch having a capability for effecting desired processing of an electrode as well as disconnection thereof during operational use of the lamp. Also, the electrode disconnect switch is positioned such that interference thereof with the joining of an envelope and stem member is not a problem and provision is made for removing the electrode heating capability during manufacture.

While there has been shown and described what is at present considered the preferred embodiments of the invention, it will be obvious to those skilled in the art that various changes and modifications may be made therein without departing from the invention as defined by the appended claims.

What is claimed is:

1. A 40-watt type rapid start fluorescent lamp operable at a current in the range of about 350 to 475 ma and having an envelope with a phosphor-coated inner wall surface, a low pressure fill gas, an electrode within each end of the envelope and a pair of electrically conductive leads passing through each end of said envelope for coupling each of said electrodes to an energization source, said fluorescent lamp characterized by the improvement wherein an electrode disconnect switch is affixed to at least one of said pair of electrical leads associated with at least one of said electrodes within said envelope, said electrode disconnect switch including a bimetal switch operable at temperatures in the range of about 75° C. to 300° C. and normally closed at room temperature and open at a predetermined temperature higher than room temperature and spaced at least 8.0 mm from said electrode and a pair of electrical conductors coupled to said bimetal switch, one of said pair of electrical conductors of said disconnect switch connected to one of said pair of electrically conductive leads of said lamp and the other of said pair of electrical conductors of said disconnect switch connected to said electrode with the other of said pair of electrically conductive leads of said lamp coupling said electrode to said energization source.

2. The rapid start fluorescent lamp of claim 1 wherein said electrode disconnect switch is disposed within a glass bottle.

3. The rapid start fluorescent lamp of claim 1 wherein said bimetal switch is in the form of a substantially U-shaped bimetal switch.

4. The rapid start fluorescent lamp of claim 1 wherein said electrode disconnect switch is disposed within a hermetically sealed bottle having a fill gas selected from the group consisting of nitrogen, the noble gases and combinations thereof.

5. The rapid start fluorescent lamp of claim 1 wherein said electrode disconnect switch has an average spacing from said electrode of not less than about 8.0 mm and not more than about 14.0 mm.

6. The rapid start fluorescent lamp of claim 1 wherein said electrode disconnect switch is operable at a temperature in the range of about 140° C. to 180° C.

7. In a 40-watt type rapid start fluorescent lamp operable at a current in the range of about 350 to 475 ma and having a glass envelope with a phosphor coated inner wall surface, a fill gas and a pair of spaced electrodes disposed within the opposite ends of said glass envelope with a pair of electrically conductive leads passing through each end of said envelope for coupling said electrodes to an energization source, the improvement comprising at least one electrode disconnect switch disposed within said lamp and having an average spacing of at least 8.0 mm from one of said electrodes, said electrode disconnect switch having a bimetal switch means normally closed at room temperature and open at a predetermined temperature higher than room temperature with a pair of electrical conductors connected to said bimetal switch means, one of said pair of electrical conductors coupling said bimetal switch to said electrode and the other of said pair of electrical conductors coupling said bimetal switch to one of said electrically conductive leads of said lamp and said other electrically conductive lead coupling said electrode to said energization source.

8. The improvement of claim 7 wherein said bimetal switch means is hermetically sealed within a glass bottle and operable at a temperature in the range of about 75° C. to 300° C.

9. The improvement of claim 7 wherein said bimetal switch means is hermetically sealed within a glass bottle having a fill gas therein selected from the group consisting of nitrogen, the noble gases and combinations thereof.

10. The improvement of claim 7 wherein said bimetal switch means is hermetically sealed within a glass bottle and operable at an average spacing of about 8.0 to 14.0 mm from said electrode.

11. The improvement of claim 7 wherein said bimetal switch means is hermetically sealed within a glass bottle and operable at a temperature in the range of about 140° C. to 180° C.

* * * * *